US005613924A

United States Patent [19]

Lee

[11] Patent Number: 5,613,924

[45] Date of Patent: Mar. 25, 1997

[54] BODY EXERCISER

[76] Inventor: Sunny Lee, No. 257-8, Chung-Cheng Rd., Tsao-Tun Chen, Nan-Tou Hsien, Taiwan

[21] Appl. No.: 661,449

[22] Filed: Jun. 11, 1996

Related U.S. Application Data

[63] Continuation-in-part of Ser. No. 628,888, Apr. 5, 1996.

[51] Int. Cl.[6] ..... A63B 22/00

[52] U.S. Cl. ..... 482/51; 434/255

[58] Field of Search ..... 482/51, 52, 53, 482/54, 70, 148; 434/255

[56] References Cited

U.S. PATENT DOCUMENTS

| | | | |
|---|---|---|---|
| 4,940,233 | 7/1990 | Bull et al. | 482/53 |
| 5,000,443 | 3/1991 | Dalebout et al. | 482/51 |
| 5,290,211 | 3/1994 | Stearns | 482/53 |
| 5,336,141 | 8/1994 | Vittone | 482/70 |
| 5,419,747 | 5/1995 | Piaget et al. | 482/51 |
| 5,496,235 | 3/1996 | Stevens | 482/51 |
| 5,536,224 | 7/1996 | Hsieh | 482/51 |

*Primary Examiner*—Stephen R. Crow
*Attorney, Agent, or Firm*—Renner, Otto, Boisselle & Sklar

[57] ABSTRACT

A body exerciser includes a frame body which has U-shaped first and second support frames that are connected pivotally to one another. A pair of walking units are connected pivotally to the branches of the first support frame by means of locking bolts and nut members. Tightening or loosening the nut members can increase or decrease the resistant force against the pivoting movement of the walking units. A resistant device interconnects the walking units and the first and second support frames in order to provide a given resistant force against the pivoting movement of the walking units. A U-shaped support member is mounted rotatably and lockably to the first support frame. An abutting plate is mounted to the U-shaped support member. A counting device is mounted to the body exerciser in order to count the number of the pivoting movement of the walking units.

8 Claims, 12 Drawing Sheets

BODY EXERCISER

CROSS-REFERENCE OF RELATED APPLICATION

This invention is a continuation-in-part (CIP) application of U.S. patent application Ser. No. 08/628,888, which was filed on Apr. 5, 1996 and is now pending.

BACKGROUND OF THE INVENTION

1. Field of the Invention

This invention relates to a body exerciser, more particularly to a body exerciser which has varied exercising resistance and which is foldable.

2. Description of the Related Art

Referring to FIG. 1, a conventional body exerciser 10 is shown to comprise a frame body 11, the front end of the top frame of the frame body 11 has a grasp rod 111 connected transversely thereto. The rear end of the top frame of the frame body 11 has a pair of walking units 12 connected pivotally thereto. Each of the walking units 12 has a foot-supporting plate 121 connected thereto so that a user's can stand on the latter and move his feet back and forth for exercising purposes. However, the exercising resistant force which is applied by the conventional body exerciser against the movement of the user's feet is fixed and is unable to be adjusted. In addition, the conventional body exerciser cannot be folded, resulting in difficult transportation and storage of the body exerciser.

SUMMARY OF THE INVENTION

It is therefore an object of the present invention to provide a body exerciser in which the exercising resistant force can be adjusted.

Another object of the present invention is to provide a body exerciser which is foldable in order for easy transportation and storage thereof.

According to the present invention, a body exerciser comprises:

a frame body having U -shaped first and second support frames, each of the first and second support frames having a spaced pair of upwardly extending branches, each of the branches of the first support frame having an upper section which is formed with a pair of spaced lugs, a hollow pivot tube which extends transversely through and is connected integrally to the upper section below the spiced lugs, and an engaging portion which is connected to the upper section below the pivot tube, each of the pivot tube having a first end and a second end which has two diametrically opposite notches formed thereon, the second ends of the pivot tubes being extended toward one another, the branches of the second support frame having two upper ends, each of the upper ends being connected pivotally to a respective one of the engaging portions of the first support frame;

means for selectively arresting pivoting movement of the second support frame relative to the first support frame;

a pair of walking units, each having an L-shaped member with upper and lower ends, a sleeve member connected transversely to the upper end of the L-shaped member, a handle connected pivotally adjacent to the upper end of the L-shaped member, means for arresting pivoting movement of the handle relative to the L-shaped member, and a foot-supporting plate connected to the lower end of the L-shaped member, each of the sleeve member being journal Led on the pivot tube via a respective one of the second ends of the pivot tubes and having first and second ends, and a hollow cylindrical member with first and second ends, the first end of each of the cylindrical members having two axial projections which extend into a respective one of the second ends of the sleeve members so as to engage the notches of the respective one of the second ends of the pivot tubes, each of the cylindrical members has an annular flange which extends radially from an internal face thereof, thereby forming a counterbore adjacent to a corresponding one of the second ends of the cylindrical members;

two locking bolts, each having a head portion and a threaded shaft extending from the head portion, the head portion of each the locking bolts being received nonrotatably in a respective one of the counterbores of the cylindrical members, the threaded shaft of each of the locking bolts extending through a respective one of the cylindrical members and having a distal end which extends out of a respective one of the pivot tubes, the distal end of each of the threaded shafts of the locking bolts engaging a nut member in order to interconnect pivotally a corresponding one of the walking units and a corresponding one of the branches of the first support frame, thereby permitting a back and forth movement of the walking units relative to the first support frame, the first end of each of the sleeve members abutting against the corresponding one of the branches of the first support frame when a corresponding one of the nut members is tightened to abut against a respective one the first ends of the pivot tubes;

a resistant device interconnecting the first and second support frames and the walk units in order to provide a resistant force against pivoting movement of the walk units relative to the first and second support frames;

a U-shaped support member having a pair of arm portions, each of the arm portions having a bent distal end which is clamped rotatably between the pair of spaced lugs of a respective one of the branches of the first support frame;

means for selectively arresting pivoting movement of the U-shaped support member relative to the first support frame; and means for counting the number of the back and forth pivoting movement of the walking units relative to the first support member.

In the preferred embodiment, the U-shaped support member has an abutting plate mounted rotatably and slidably thereto so that the user's back or belly can abut against the abutting plate. A first resistant ring member is sandwiched between each of the nut members and the first end of each of the pivot tubes. A second resistant ring member is sandwiched between the first end of each of the sleeve members and the respective one of the branches of the first support frame. A third resistant ring member is sandwiched between the second end of each of the sleeve members and the first end of each of the cylindrical members. Therefore, the frictional forces between the cylindrical members, the sleeve members, the pivot tubes and the nut members can be increased.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
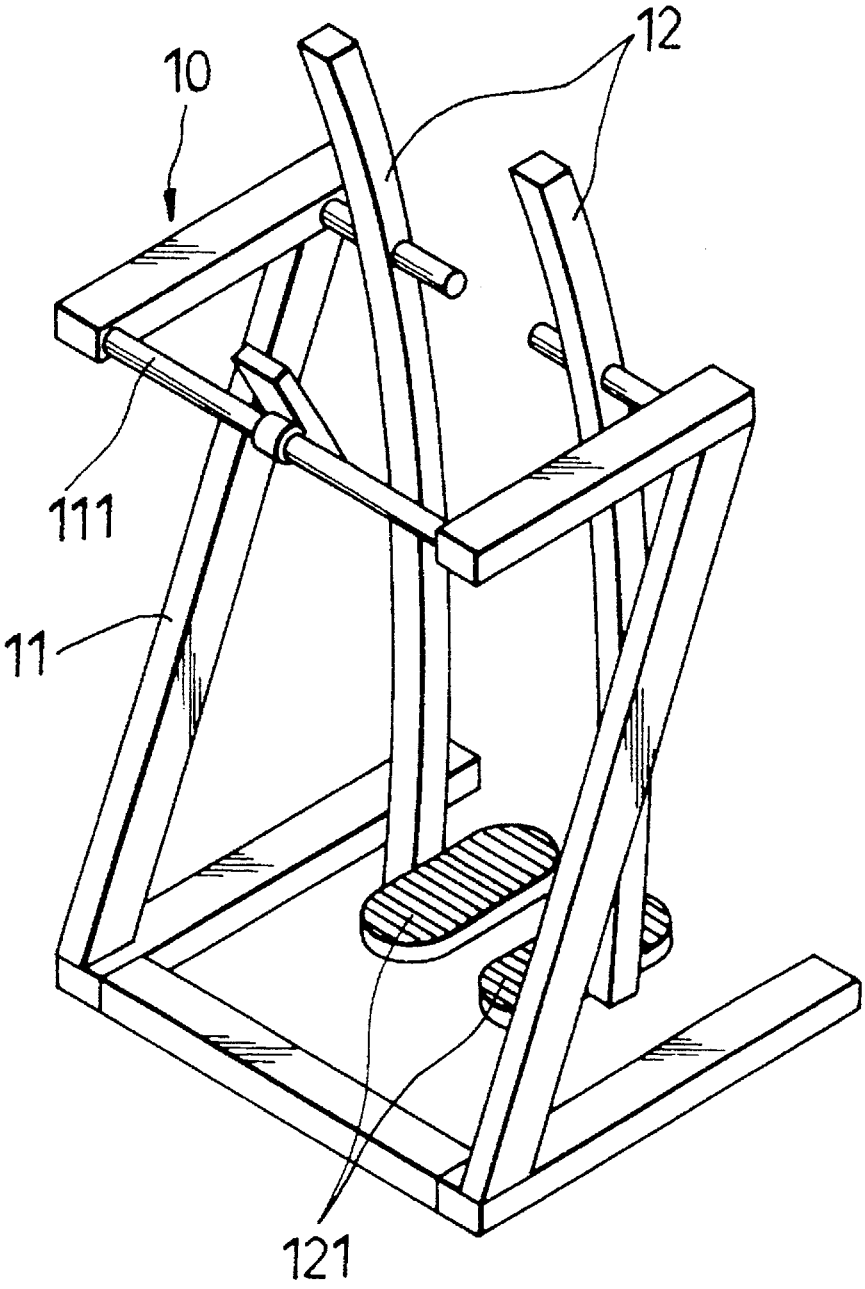
FIG.1 PRIOR ART
FIG. 1 is a perspective view of a conventional body exerciser.

Before the present invention is disclosed in greater detail, it should be noted that like elements are denoted by the same reference numerals throughout the disclosure.

Figure 2:
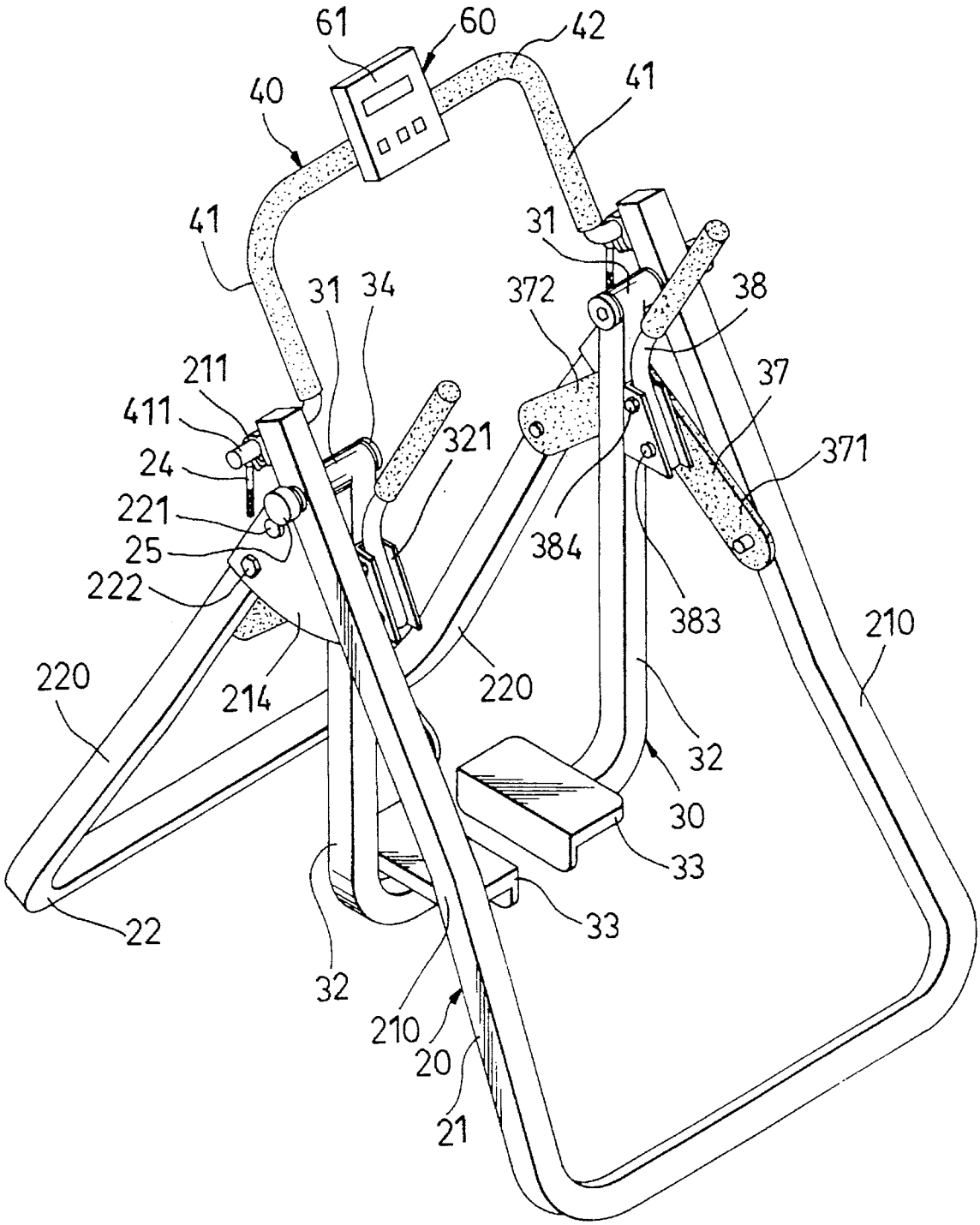
FIG. 2 is a perspective view of a first preferred embodiment of a body exerciser according to the present invention.

Referring to FIG. 2, a first preferred embodiment of a body exerciser according to the present invention is shown to comprise a frame body 20, a pair of walking units 30, two locking bolts 35, a resistant device interconnecting the frame body 20 and the walking units 30, and a U-shaped support member 40.

Figure 3:
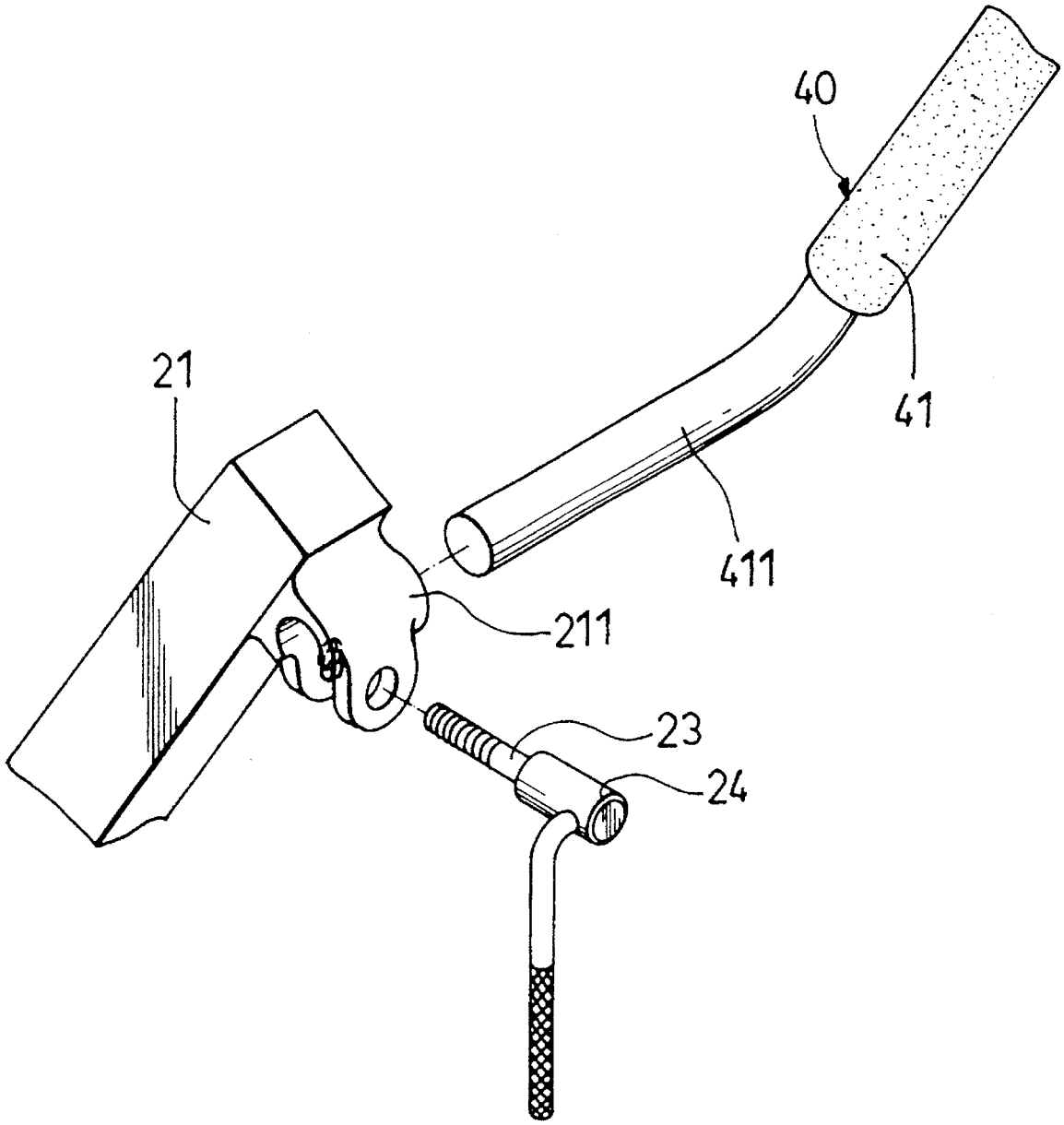
FIG. 3 is a fragmentary exploded view illustrating structures of one of the distal ends of a U-shaped support member and the distal end of each of the branches of a first support frame according to the present invention.
Figure 4:
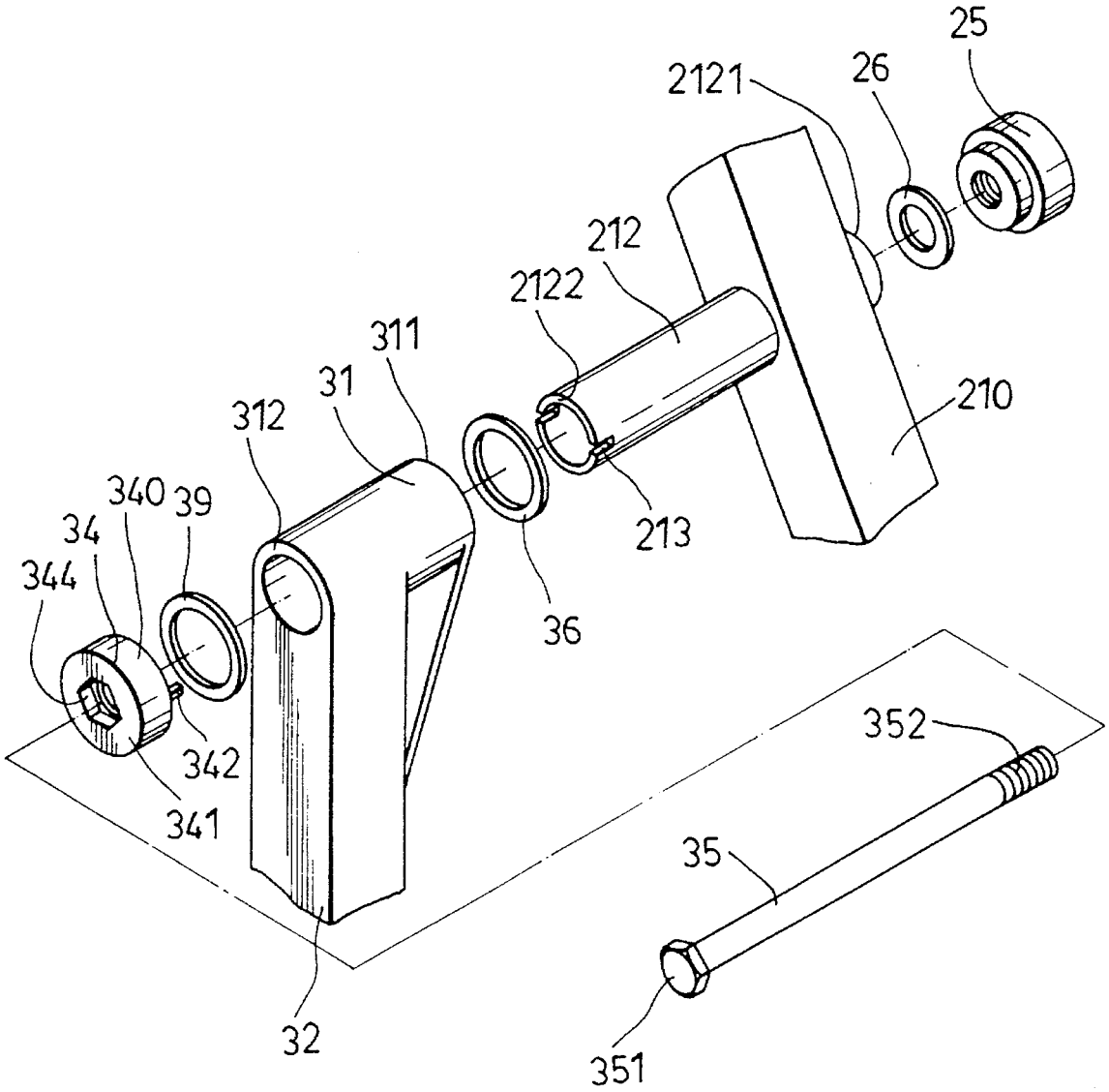
FIG. 4 is a fragmentary exploded view illustrating the structures of the first supporting frame and the sleeve member of a walking unit according to the present invention.
Figure 7:
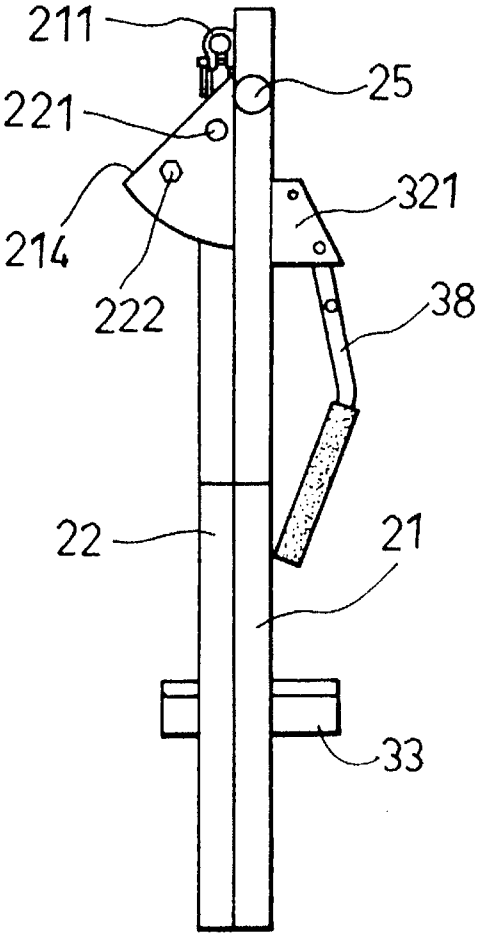
FIG. 7 is a side view illustrated the first preferred embodiment of the body exerciser in a folded position.

The frame body 20 has U-shaped first and second support frames 21, 22. Each of the first and second support frames 21, 22 has a spaced pair of upwardly extending branches 210, 220. The upper section of each of the branches 210 of the first support frame 21 is formed with a pair of spaced lugs 211, as best illustrated in FIG. 3. A hollow pivot tube 212 extends transversely through and is connected integrally to the upper section below the spaced lugs 211, as best illustrated in FIG. 4. Each of the pivot tube 212 has a first end 2121 a second end 2122 which has two diametrically opposite notches 213 formed thereon. The second ends 2122 of the pivot tubes 212 are extended toward one another. An engaging portion 214 is connected to the upper section below the pivot tube 212. The branches 220 of the second support frame 22 have two upper ends, as shown in FIG. 2. Each of the upper ends is connected pivotally to a respective one of the engaging portions 214 of the first support frame 21 by means of a pivot pin 221 so that the second support frame 22 can be pivoted between an extended position, as shown in FIG. 2 and a folded position, as shown in FIG. 7. A bolt and nut fastener 222 is used to serve as a means for selectively arresting pivoting movement of the second support frame 22 relative to the first support frame 21 when the second support frame 22 is in the extended position.

Figure 5:
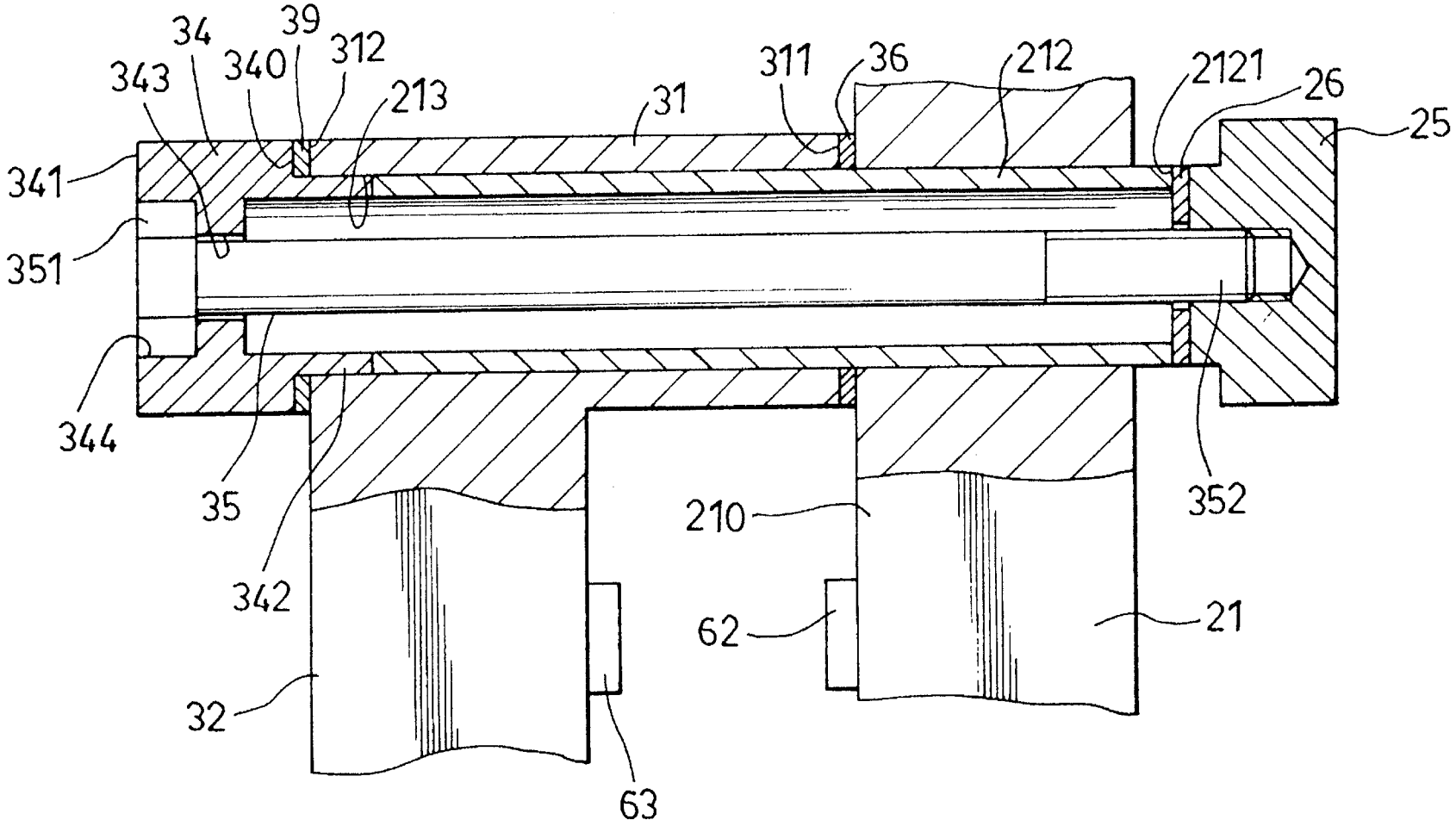
FIG. 5 is a fragmentary sectional view illustrating how the sleeve tube is connected to the first support frame according to the present invention.
Figure 6:
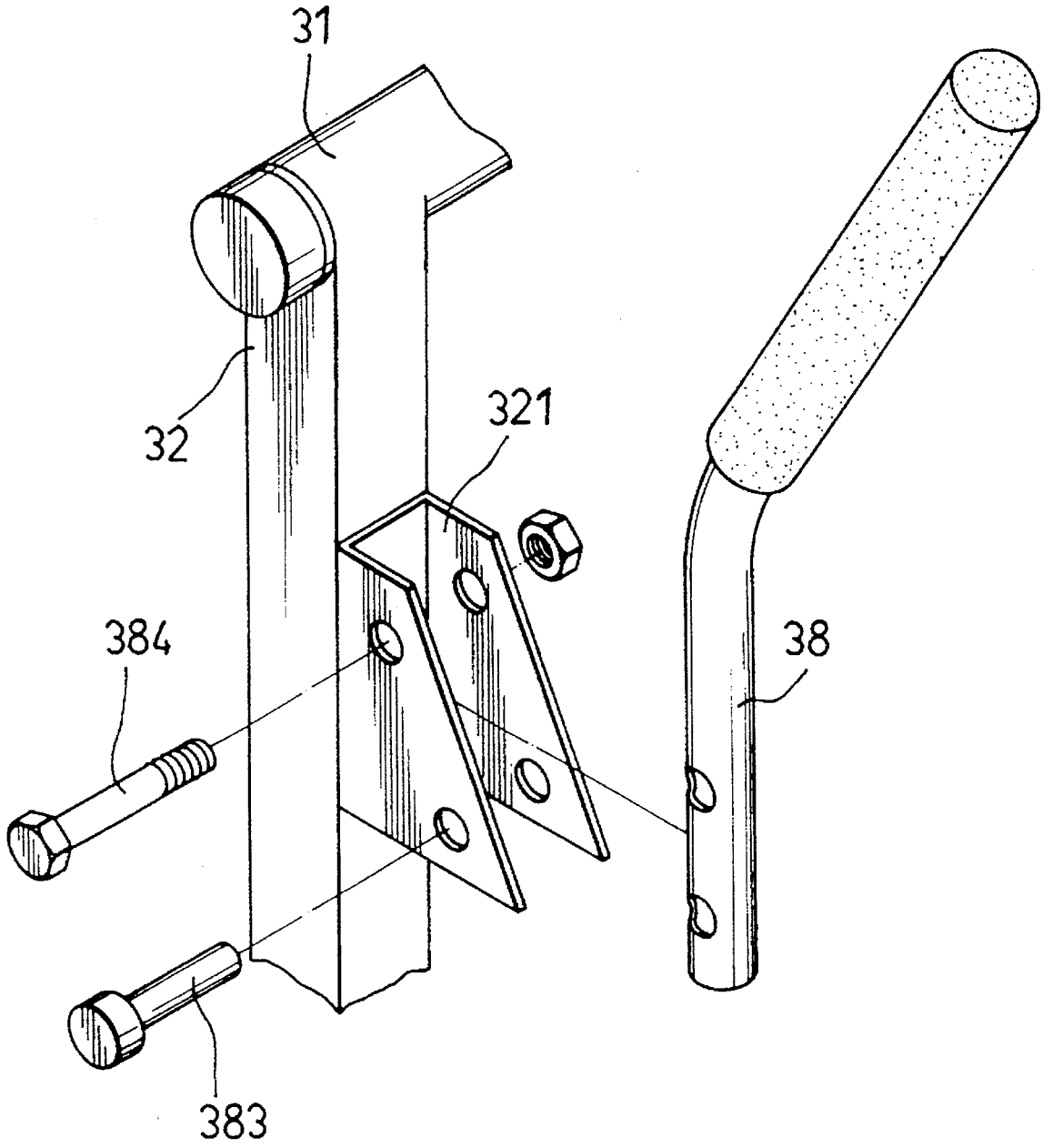
FIG. 6 is a fragmentary exploded view illustrating how a handle can be connected to the first support frame according to the present invention.

Referring to FIG. 2, each of the walking units 30 has an L-shaped member 32 with upper and lower ends, a sleeve member 31 which is connected transversely to the upper end of the L-shaped member 32, and a foot-supporting plate 33 which is connected to the lower end of the L-shaped member 32. Each of the sleeve member 31 is journalled on the pivot tube 212 via a respective one of the second ends 2122 of the pivot tubes 212 and has first and second ends 311, 312, as shown in FIG. 4, and a hollow cylindrical member 34 with first and second ends 340, 341. The first end 340 of each of the cylindrical members 34 has two axial projections 342 which extend into a respective one of the second ends 312 of the sleeve members 31 so as to engage the notches 213 of the respective one of the second ends 2122 of the pivot tubes 212, as best illustrated in FIG. 5. Each of the cylindrical members 34 has an annular flange 343 which extends radially from the internal face of the cylindrical member 34, thereby forming a counterbore 344 adjacent to the second end 341 of the cylindrical member 34. In this embodiment, the counterbore has a hexagonal shape. Each of the L-shaped member 32 has a handle 38 which is connected pivotally to a connecting member 321 adjacent to the upper end of the L-shaped member 32 by means of a pivot pin 383, as best illustrated in FIG. 6. A bolt and nut fastener 384 is provided to serve as a means for arresting pivoting movement of the handle 38 relative to the L-shaped member 32.

Referring to FIGS. 4 and 5, each of the locking bolts 35 has a hexagonal head portion 351 and a threaded shaft 352 extending from the head portion 351. The head portion 351 of each the locking bolts 35 is received nonrotatably in a respective one of the counterbores 344 of the cylindrical members 34. The threaded shaft 352 of each of the locking bolts 35 extends through a respective one of the cylindrical members 34 and has a distal end which extends out of a respective one of first ends 2121 of the pivot tubes 212. The distal end of each of the threaded shafts 352 engages a nut member 25 in order to interconnect pivotally a corresponding one of the walking units 30 and a corresponding one of the branches 210 of the first support frame 21, thereby permitting a back and forth movement of the walking units 30 relative to the first support frame 21. The first end 311 of each of the sleeve members 31 abut against the corresponding one of the branches 210 of the first support frame 21 when a corresponding one of the nut members 25 is tightened to abut against respective one the first ends 2121 of the pivot tubers 212. A first resistant ring member 26 is sandwiched between each of the nut members 25 and the first end 2121 of each of the pivot tubes 212. A second resistant ring member 36 is sandwiched between the first end 311 of each of the sleeve members 31 and the respective one of the branches 210 of the first support frame 21. A third resistant ring member 39 is sandwiched between the second end 312 of each of the sleeve members 31 and the first end 340 of each of the cylindrical members 34. Therefore, the frictional forces between the cylindrical members 34, the sleeve members 31, the branches 210 of the first support frame 21, and the nut members 25 can be increased or increased by tightening or loosening the nut members 25.

Referring back to FIG. 2, the resistant device is shown to comprise two pairs of elastic bands 37. Each pair of elastic bands 37 has a first band 371 which has a first end that is connected to a respective one of the L-shaped members 32 and a second end that is connected to the corresponding one of the branches 210 of the first support frame 21, and a second band 372 which has a first end that is connected to the respective one of the L-shaped members 32 and a second end that is connected to a corresponding one of the branches 220 of the second support frame 22.

Figure 8:
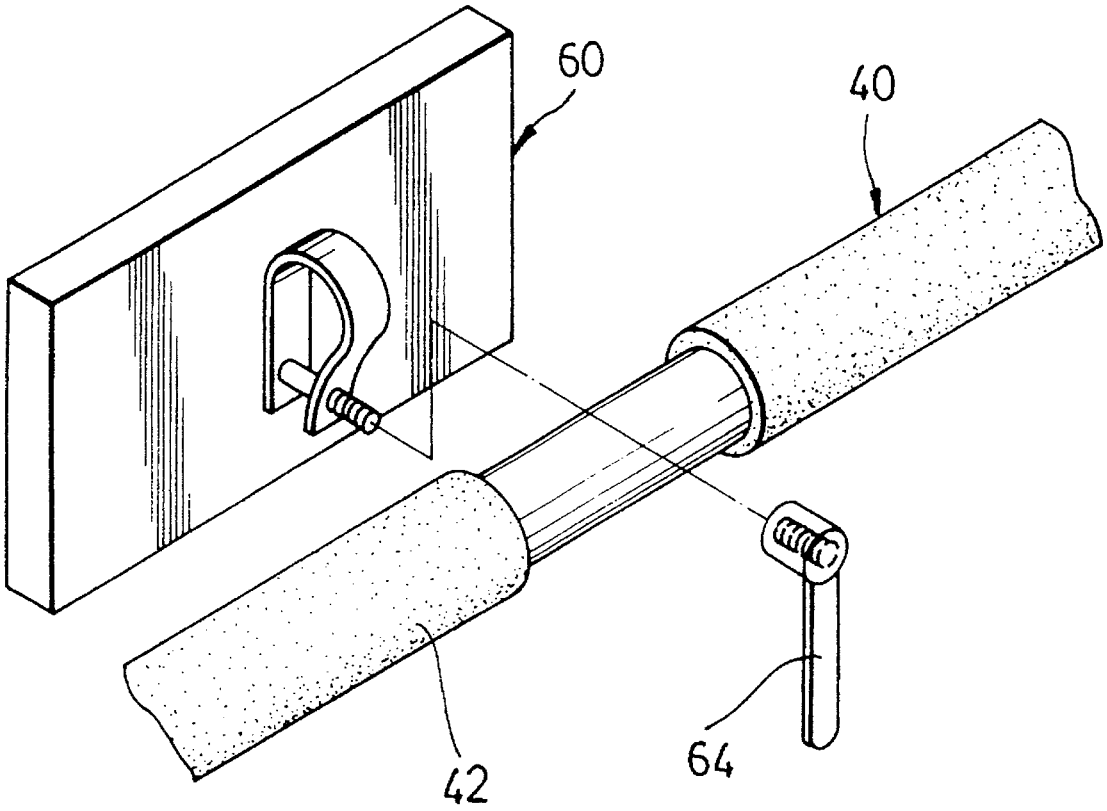
FIG. 8 is a fragmentary exploded view illustrating how a counting means is connected to the U-shaped support member according to the present invention.

The U-shaped support member 40 has a pair of arm portions 41. Each of the arm portions 41 has a bent distal end 411 which is clamped rotatably between the pair of spaced lugs 211 of a respective one of the branches 210 of the first support frame 21. Each pair of spaced lugs 211 has a Molt member 23 and a quick-releasing lever 24 which engages the bolt member 23 which serve as means for selectively arresting pivoting movement of the U-shaped support member 40 relative to the first support frame 21. A counting means 60 is mounted to the body exerciser for counting the number of the back and forth pivoting movement of the walking units 30 relative to the first support member 21. The counting means 60 has a display member 61 which is mounted rotatably to the cross bar 42 of the U-shaped support member 40, a photosensor 62 fixed to one of the branches 210 of the first support frame 21, and a magnetic member 63 which is fixed to one of the walking units 30 and which corresponds to the photosensor 62. The structure and the operation of the counting means 60 are conventional and will not be detailed herein. Preferably, the rear side of the display member 61 has a quick-releasing device 64 connected thereto in order to position releasably the display member 61 to cross bar 42 the U-shaped support member 40, as shown in FIG. 8. In addition, the length of the cross bar 42 is longer than the distance between the L-shaped members 32 of the walking units 30 in order to prevent rolling of the walking units 30 when the second support frame 22 is in the folded position, as best illustrated in FIG. 10.

Figure 9:
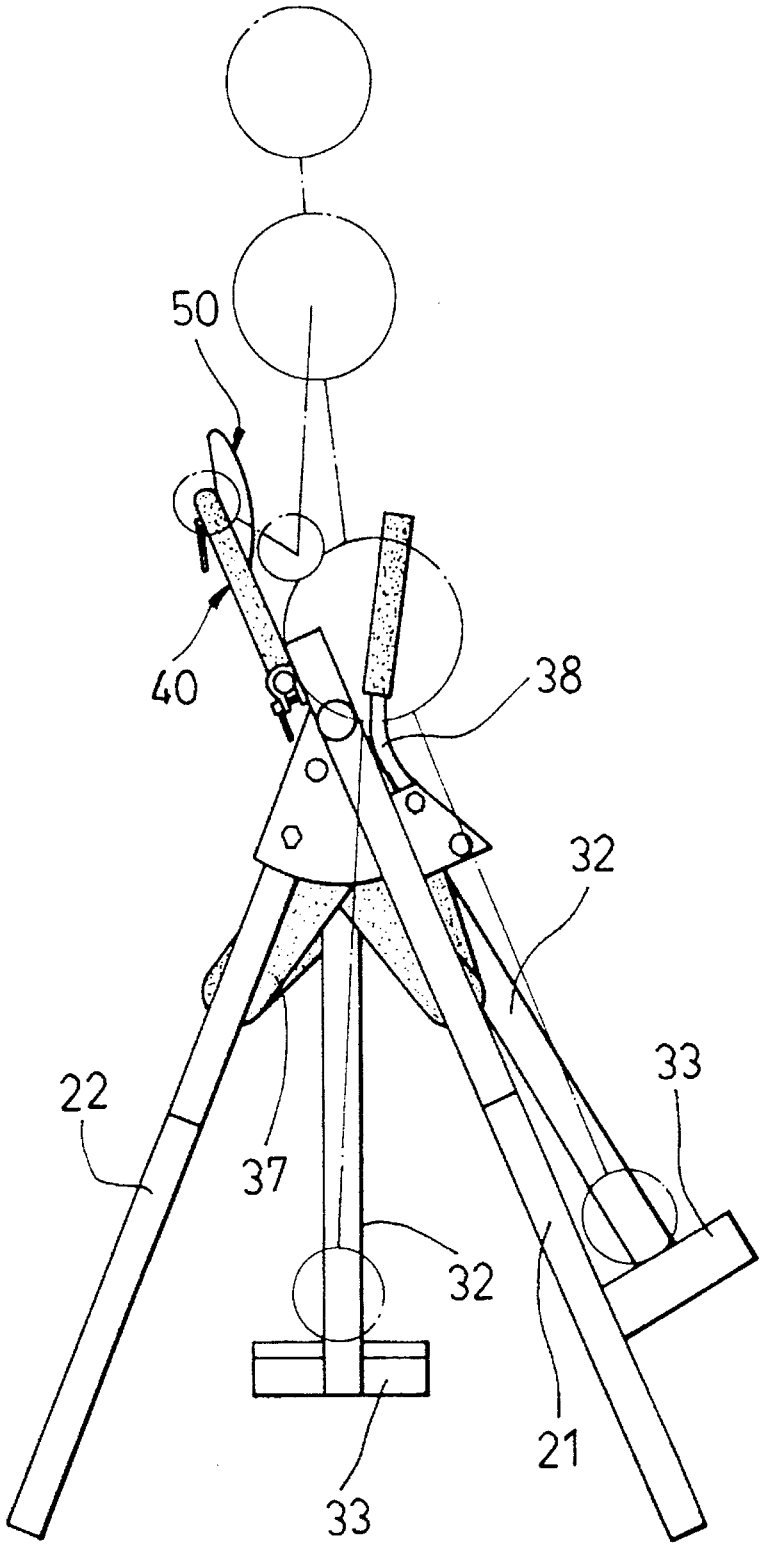
FIG. 9 is a schematic view illustrating the first preferred embodiment of the body exerciser in an operative position.

Referring to FIG. 9, an abutting plate 50 may be mounted rotatably and slidably to the U-shaped support member 40 so that the user's belly can abut against the former for exercising purposes. Before the abutting plate 50 is mounted to the U-shaped support member 40, the quick-releasing device 64 is released and the display member 61 is moved toward one end of the cross bar 42 and is rotated downward in order to allow the abutting plate 50 to be mounted in the middle section of the cross bar 42.

In use, with reference to FIG. 9, the user stands on the foot-supporting plates 33 of the walking units 30 and moves his legs back and forth for exercising purposes while grasping the U-shaped support member 40. Alternatively, the user can grasp the handles 38 while walking to permit his arms to move back and forth with the walking units 30. Meanwhile, the display member 61 of the counting means 60 will indicate the number of the movement of the walking units 30. When the walking exercise is effected, the resistant device can provide a given resistant force against the pivoting movement of the walking units 30. In addition, a secondary resistant force can be applied onto the walking units 30 by tightening the nut members 25 to increase the frictional forces between the sleeve members 31, the resistant ring member 36, and the branches 210 of the first support frame 21 as aforementioned. On the contrary, the secondary resistant force may be decreased by loosening the nut members 25. Alternatively, the user can release the quick-releasing device 64 in order to move aside the display member 61 and mount the abutting plate 50 to the U-shaped support member 40 as mentioned above. Thus, the user's belly may abut against the abutting plate 50 in order to exercise the belly when the user exercises his legs.

Figure 10:
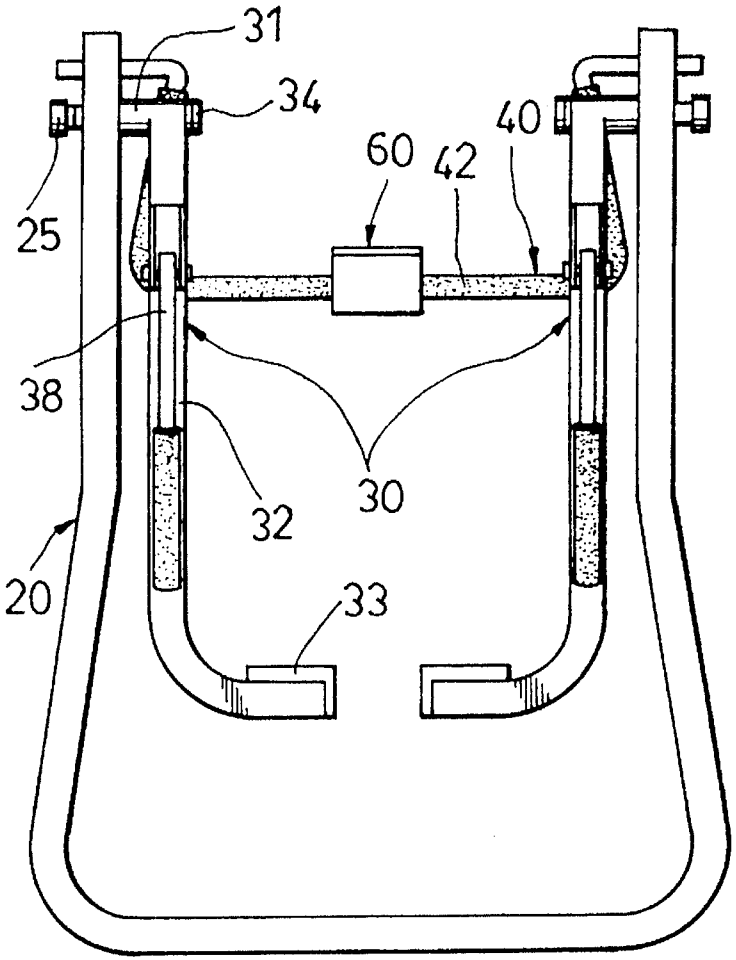
FIG. 10 is a front View illustrated the first preferred embodiment of the body exerciser in the folded position.

When the body exerciser is not in use and is to be stored, the bolt and nut fastener 384 is removed and the handles 38 are rotated downward to a folded position, as best illustrated in FIGS. 7 and 10. The U-shaped support member 40 is then rotated downward to a folded position by means of releasing the bolts 23 and the quick-releasing levers 24 from the spaced lugs 211. Finally, the bolt and nut fastener 222 is removed in order to allow the second support frame 22 to be folded relative the first support frame 21.

Figure 11:
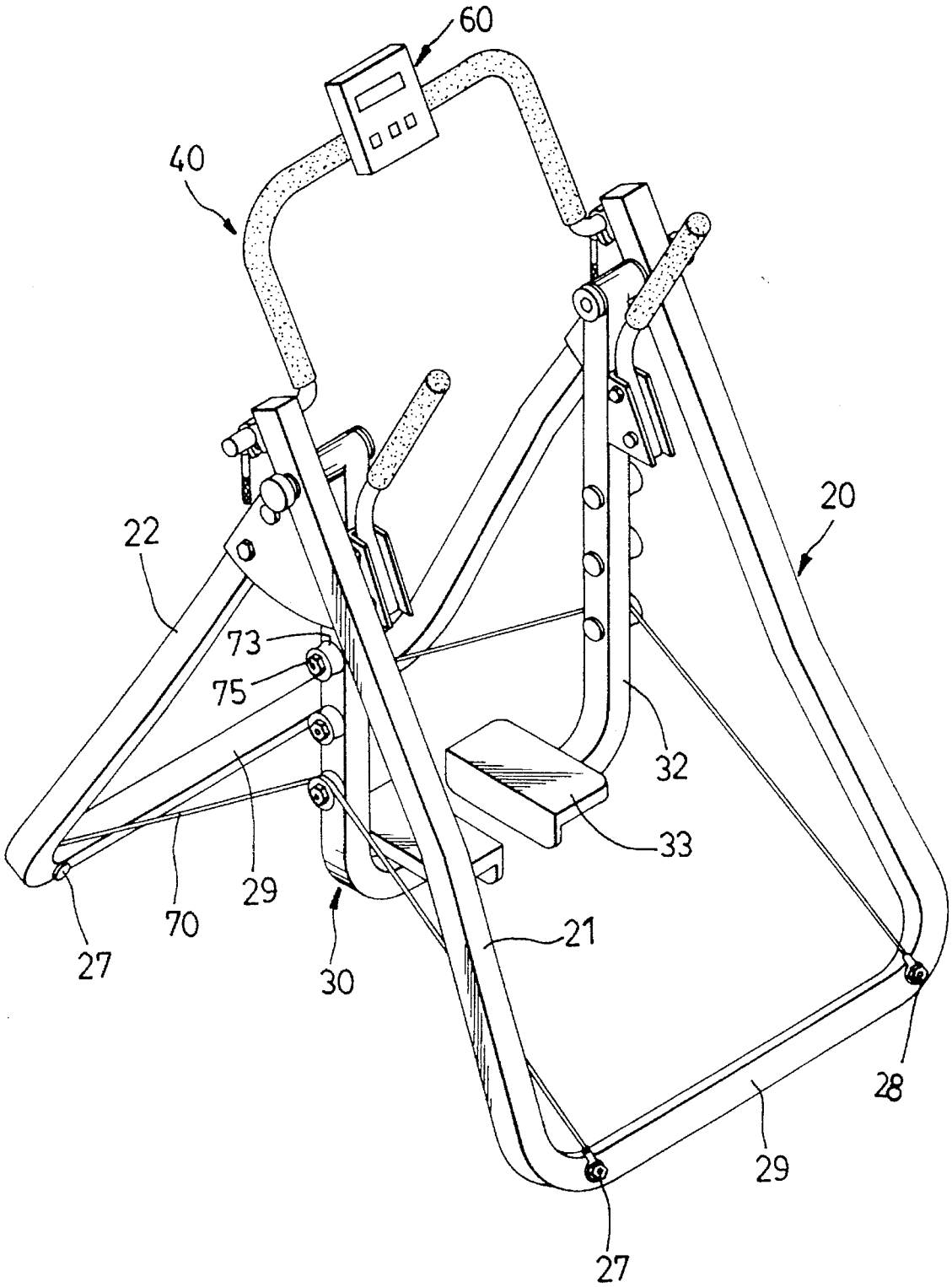
FIG. 11 is a perspective view of a second preferred embodiment of the body exerciser according to the present invention.
Figure 12:
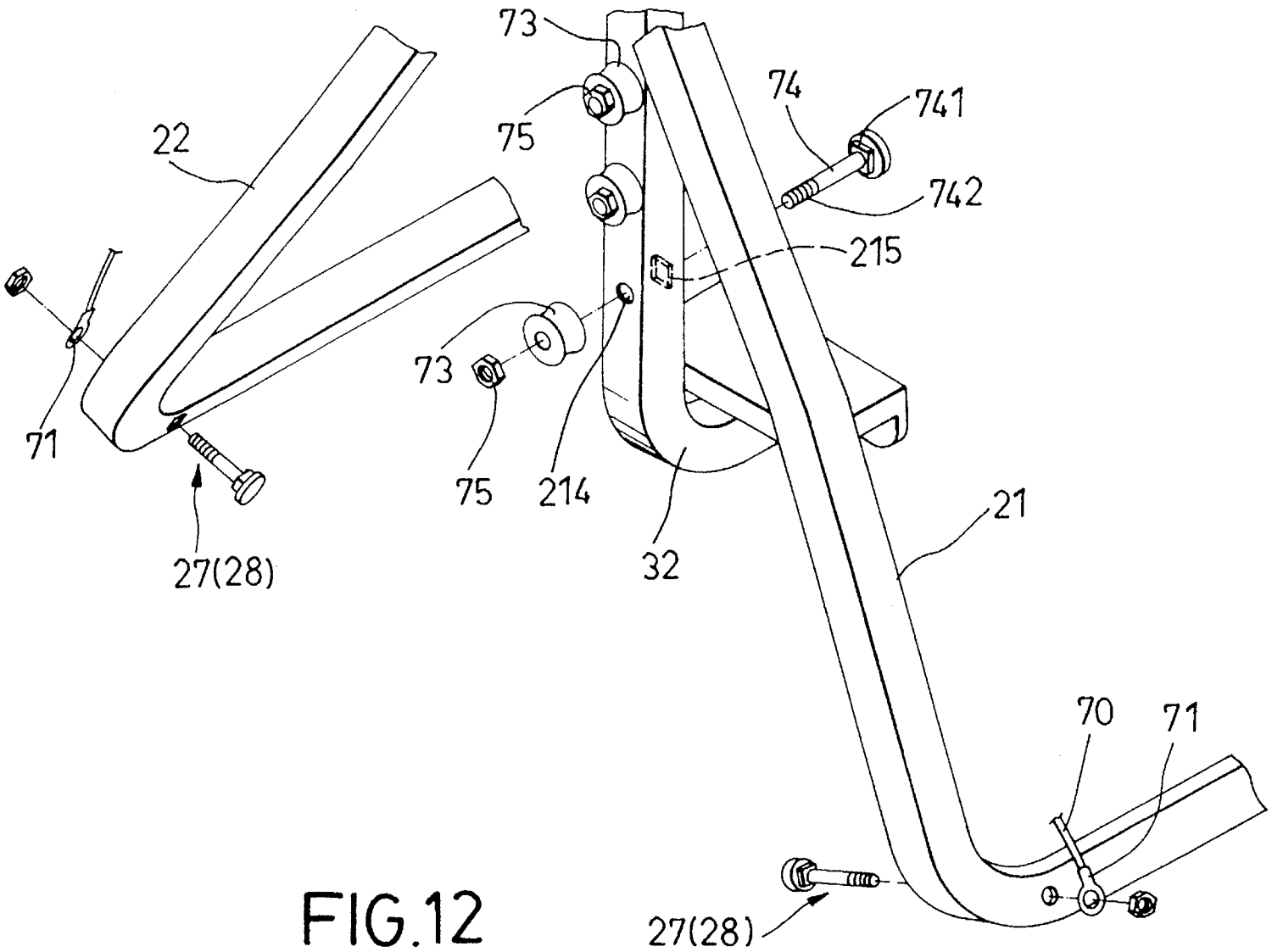
FIG. 12 is a fragmentary exploded view illustrating how the bobbins are connected to the L-shaped members of the second preferred embodiment according to the present invention.

FIG. 11 illustrates a second preferred embodiment of the body exerciser according to the present invention. In this embodiment, the structure of the body exerciser is similar to that of the body exerciser of the first embodiment except that each base frame 29 which interconnects the branches 210, 220 of a respective one of the first and second support frames 21, 22 has first and second bolt and nut fasteners 27, 28 connected thereto, and that the resistant device includes a plurality of bobbins 73 and two elastic cords 70 instead of the elastic bands 70 of the first embodiment. The bobbins 73 are connected rotatably to the L-shaped members 32 by means of a plurality of carriage bolts 74 and spaced from one another in the longitudinal direction of the L-shaped members 32, as best illustrated in FIG. 12. The carriage bolts 74 are connected nonrotatably to the L-shaped members 32 and spaced from one another along the longitudinal direction of said L-shaped members 32. Each of the carriage bolts 74 has a square neck portion 741 which engages a square hole 215 that is formed in a side of a corresponding one of L-shaped members 32. Each of the carriage bolts 74 further has a threaded shaft portion 742 which extends transversely through a circular hole 214 that is formed in the opposed side of the corresponding one of said L-shaped members 32 and through a corresponding one of the bobbins and which engages a nut 75 in order to fasten rotatably the corresponding one of the bobbins 73 to the carriage bolt 74.

Figure 13:
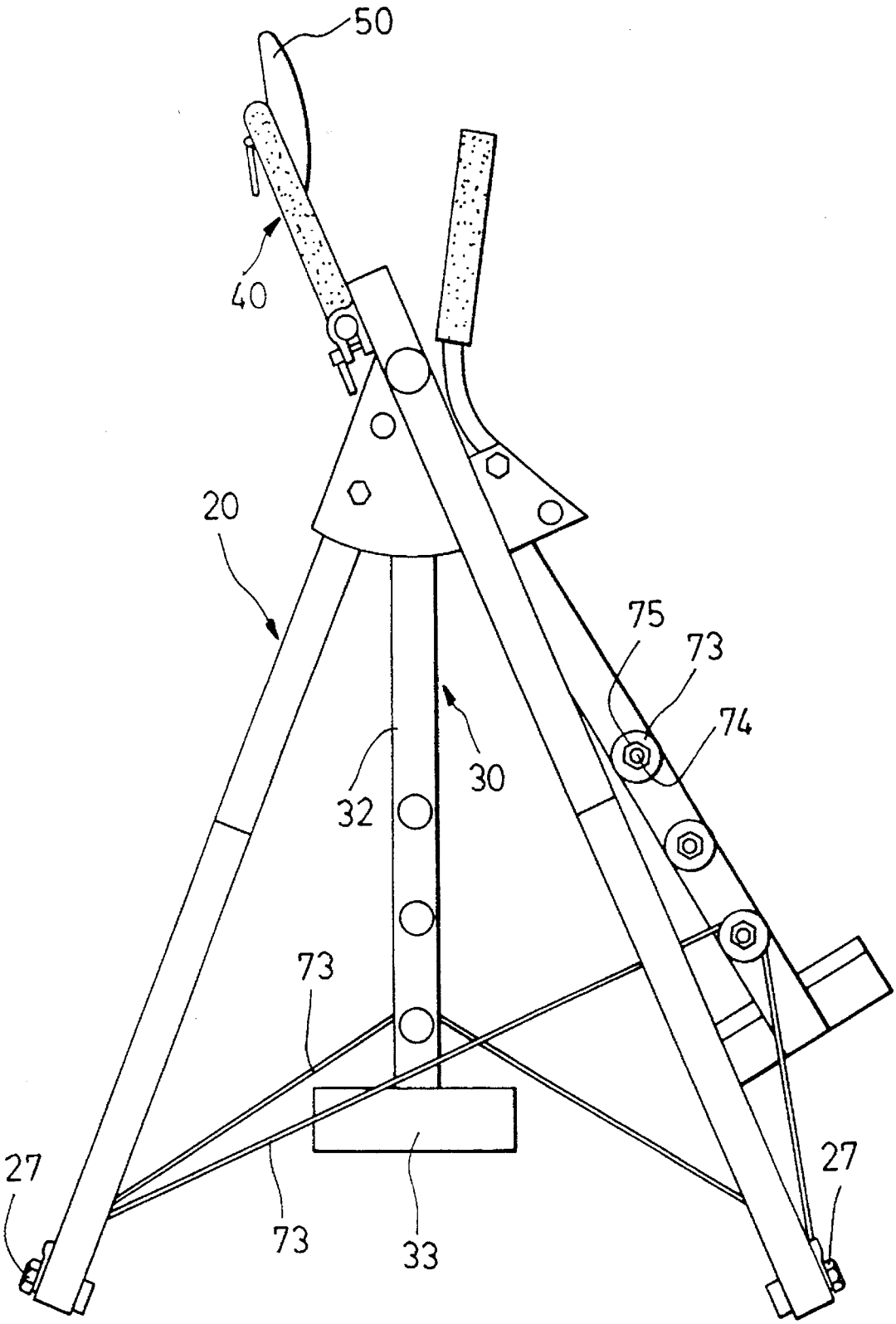
FIG. 13 is a schematic side view illustrating how the second preferred embodiment of the body exerciser is operated according to the present invention.

Referring to FIG. 12, the first bolt and nut fasteners 27 and the bobbins 73 of one of the L-shaped members 32 are located generally in a first plane while the second bolt and nut fasteners 28 and the bobbins 73 of the other one of the L-shaped members 32 are generally located on a second plane. Each cord 70 has two looped ends 71 which are fastened a respective ones of the first bolt and nut fasteners 27 that are located on the first plane and the second bolt and nut fasteners 28 that is located on the second plane. Thereby, each of the cords 70 passes over one of the bobbins 73 of a respective One of the L-shaped members 32 under tension. It is noted that because the cords 70 are located respectively on the first and second planes, they are not twisted when the bobbins 73 are moved along the cords 70, preventing the disengagement of the cords from the bobbins 73. In use, the bobbins 70 slide along the cords 70 when the walking units 30 is moved back and forth, resulting in a uniform rolling friction between the bobbins 73 and the cords 70, as best illustrated in FIG. 13. The rolling friction may serve as a uniform resistant force against the pivoting movement of the walking units 30. It is noted that the rolling friction force between the bobbins 73 and the cords 70 is larger When the cords 70 pass over the bobbins 73 adjacent to the upper ends of L-shaped members 32 and is smaller when the cords 70 pass over the bobbins 73 adjacent to the lower ends of the L-shaped members 32.

While the present invention has been described in connection with what is considered the most practical and preferred embodiments, it is understood that this invention is not limited to the disclosed embodiment but is intended to cover various arrangements included within the spirit and scope of the broadest interpretations and equivalent arrangement.

I claim:

1. A body exerciser, comprising:

a frame body having U-shaped first and second support frames, each of said first and second support frames having a spaced pair of upwardly extending branches, each of said branches of said first support frame having an upper section which is formed with a pair of spaced lugs, a hollow pivot tube which extends transversely through and is connected integrally to said upper section below said spaced lugs, and an engaging portion connected said upper section below said pivot tube, each of said pivot tube having a first end and a second end which has two diametrically opposite notches formed thereon, said second ends of said pivot tubes being extended toward one another, said branches of said second support frame having two upper ends, each of said upper ends being connected pivotally to a respective one of said engaging portions of said first support frame;

means for selectively arresting pivoting movement of said second support frame relative to said first support frame;

a pair of walking units, each having an L-shaped member with upper and lower ends, a sleeve member connected transversely to said upper end of said L-shaped member, a handle connected pivotally adjacent to said upper end of said L-shaped member, means for arresting pivoting movement of said handle relative to said L-shaped member, and a foot-supporting plate connected to said lower end of said L-shaped member, each of said sleeve member being journalled on said pivot tube via a respective one of said second ends of said pivot tubes and having first and second ends, and a hollow cylindrical member with first and second ends, said first end of each of said cylindrical members having two axial projections which extend into a respective one of said second ends of said sleeve members so as to engage said notches of the respective one of said second ends of said pivot tubes, each of said cylindrical members has an annular flange which extends radially from an internal face thereof, thereby forming a counterbore adjacent to a corresponding one of said second ends of said cylindrical members;

two locking bolts, each having a head portion and a threaded shaft extending from said head portion, said head portion of each said locking bolts being received nonrotatably in a respective one of said counterbores of said cylindrical members, said threaded shaft of each of said locking bolts extending through a respective one of said cylindrical members and having a distal end which extends out of a respective one of said pivot tubes, said distal end of each of said threaded shafts of said locking bolts engaging a nut member in order to interconnect pivotally a corresponding one of said walking units and a corresponding one of said branches of said first support frame, thereby permitting a back and forth movement of said walking units relative to said first support frame, said first end of each of said sleeve members abutting against the corresponding one of said branches of said first support frame when a corresponding one of said nut members is tightened to abut against a respective one said first ends of said pivot tubes;

a resistant device interconnecting said first and second support frames and said walk units in order to provide a resistant force against pivoting movement of said walking units relative to said first and second support frames;

a U-shaped support member having a pair of arm portions, each of said arm portions having a bent distal end which is clamped rotatably between said pair of spaced lugs of a respective one of said branches of said first support frame;

means for selectively arresting pivoting movement of said U-shaped support member relative to said first support frame; and means for counting the number of said back and forth pivoting movement of said walking units relative to said first support member.

2. A body exerciser as claimed in claim 1, wherein said U-shaped support member has an abutting plate mounted rotatably and slidably thereto.

3. A body exerciser as claimed in claim 1, wherein each of walking units has a connecting member to which a respective one of said handles is pivotally connected.

4. A body exerciser as claimed in claim 1, wherein a first resistant ring member is sandwiched between each of said nut members and said first end of each of said pivot tubes, a second resistant ring member is sandwiched between said first end of each of said sleeve members and the respective one of said branches of said first support frame, and a third resistant ring member is sandwiched between said second end of each of said sleeve members and said first end of each of said cylindrical members.

5. A body exerciser as claimed in claim 1, wherein said resistant device includes two pairs of elastic bands, each pair of said elastic bands having a first band which has a first end that is connected to a respective one of said L-shaped members and a second end that is connected to the corresponding one of said branches of said first support frame, and a second band which has a first end that is connected to the respective one of said L-shaped members and a second end that is connected to a corresponding one of said branches of said second support frame.

6. A body exerciser as claimed in claim 1, wherein each of said first and second support frames has a base frame interconnecting a respective one of said branches thereof, each of said base frames having first and second bolt and nut fasteners connected thereto, said resistant device including a plurality of bobbins and two elastic cords, said bobbins being connected rotatably to said L-shaped members and spaced from one another in a longitudinal direction of said L-shaped members, each cord having two looped ends which are fastened a respective ones of said first bolt and nut fasteners and said second bolt and nut fasteners, each of said cords passing over one of said bobbins of a respective one of said L-shaped members under tension.

7. A body exerciser as claimed in claim 6, wherein each of said L-shaped members has a plurality of carriage bolts connected nonrotatably thereto and spaced from one another along the longitudinal direction of said L-shaped member, each of said carriage bolts having a threaded shaft portion extending transversely through a corresponding one of said L-shaped members and a corresponding one of said bobbins and engaging a nut in order to fasten rotatably the corresponding one of said bobbins to said carriage bolt.

8. A body exerciser as claimed in claim 6, wherein said first bolt and nut fasteners and said bobbins of one of said L-shaped members are located generally in a first plane and wherein said second bolt and nut fasteners and said bobbins of the other one of said L-shaped members are generally located on a second plane.

* * * * *